US006447088B2

(12) United States Patent
Tachihara et al.

(10) Patent No.: US 6,447,088 B2
(45) **Date of Patent: *Sep. 10, 2002**

(54) INK-JET HEAD, AN INK-JET-HEAD CARTRIDGE, AN INK-JET APPARATUS AND AN INK-JET RECORDING METHOD USED IN GRADATION RECORDING

(75) Inventors: Masayoshi Tachihara, Choufu; Yasuyuki Tamura, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/783,367

(22) Filed: Jan. 16, 1997

(30) Foreign Application Priority Data

Jan. 16, 1996 (JP) ..... 8-005067

(51) Int. Cl.[7] ..... B41J 2/205; B41J 2/05
(52) U.S. Cl. ..... 347/15; 347/48; 347/65
(58) Field of Search ..... 347/15, 47, 48, 347/63, 65

(56) References Cited

U.S. PATENT DOCUMENTS

| | | | | |
|---|---|---|---|---|
| 4,251,824 A | * | 2/1981 | Hara | 347/43 X |
| 4,558,333 A | * | 12/1985 | Sugitani | 347/65 |
| 4,611,219 A | * | 9/1986 | Sugitani | 347/40 |
| 4,746,935 A | * | 5/1988 | Allen | 347/15 X |
| 4,905,017 A | | 2/1990 | Sugitani et al. | 347/65 |
| 5,159,354 A | | 10/1992 | Hirasawa et al. | 347/65 |
| 5,172,139 A | * | 12/1992 | Sekiya et al. | 347/15 |
| 5,189,443 A | * | 2/1993 | Arashima | 347/87 X |
| 5,208,605 A | * | 5/1993 | Drake | 347/15 |
| 5,574,488 A | | 11/1996 | Tamura | 347/63 |
| 5,731,828 A | * | 3/1998 | Ishinaga | 347/48 X |
| 5,790,152 A | * | 8/1998 | Harrington | 347/48 |

FOREIGN PATENT DOCUMENTS

| | | | | |
|---|---|---|---|---|
| EP | 0224937 | | 6/1987 | B41J/3/04 |
| EP | 0627314 | | 12/1994 | B41J/2/14 |
| JP | 55-132258 | | 10/1980 | B41J/3/04 |
| JP | 55-132259 | | 10/1980 | B41J/3/04 |
| JP | 63-160853 | | 7/1988 | B41J/3/04 |
| JP | 1-242259 | * | 9/1989 | B41J/3/04 |
| JP | 4-361055 | * | 12/1992 | B41J/2/205 |
| JP | 5-16365 | | 1/1993 | B41J/2/05 |
| JP | 6-255132 | * | 9/1994 | B41J/2/205 |
| WO | WO87/03363 | | 6/1987 | G01D/15/16 |

* cited by examiner

*Primary Examiner*—Susan S. Y. Lee
(74) *Attorney, Agent, or Firm*—Fitzpatrick, Cella, Harper & Scinto

(57) ABSTRACT

An ink-jet head includes a plurality of ink channels for guiding ink to corresponding discharging ports, and discharging units, each including a discharging port, and a heating element, provided for the discharging port, for generating a bubble for discharging the ink by providing the ink within the corresponding ink channel with thermal energy. A plurality of discharging units having different amounts of ink discharge are provided at each of the ink channels. An ink-jet-head cartridge includes the above-described ink-jet head and an ink receptable for holding the ink to be supplied to the ink-jet head. An ink-jet apparatus includes the above-described ink-jet head and a recording-medium conveying unit for conveying a recording medium for receiving the discharged ink. In an ink-jet recording method, a head in which a plurality of discharging units, each including a heating element for generating heat for discharging ink, and a discharging port for discharging the ink, are provided at each ink channel is used, and recording is performed by discharging different amounts of ink from the discharging ports by selectively driving the plurality of discharging units.

15 Claims, 8 Drawing Sheets

INK-JET HEAD, AN INK-JET-HEAD CARTRIDGE, AN INK-JET APPARATUS AND AN INK-JET RECORDING METHOD USED IN GRADATION RECORDING

BACKGROUND OF THE INVENTION

1. Field of the Invention

This invention relates to an ink-jet head, an ink-jet-head cartridge, an ink-jet apparatus and an ink-jet recording method for performing recording on a recording material by discharging an ink droplet using a pressure caused by the generation of a bubble.

2. Description of the Related Art

An ink-jet head performs recording on a recording material by generating a bubble by providing a heater with electric energy and discharging an ink droplet using a pressure caused by the generation of the bubble. Ink-jet heads are widely used because of their silent operation, the capability of high-density printing, the ease of color printing, and the like.

In order to stably drive an ink-jet head at a high speed with a high energy efficiency, and to perform high-density recording using an ink-jet head, various attempts have been made.

In order to perform gradation recording using an ink-jet head, Japanese Patent Laid-Open Application (Kokai) Nos. 55-132258 (1980) and 63-160853 (1988) disclose recording-liquid discharging heads in which a heater whose width or thickness has a gradient is disposed within an ink channel, and in which a plurality of heaters are disposed within an ink channel.

In order to efficiently discharge an ink droplet, for example, Japanese Patent Laid-Open Application (Kokai) No. 5-16365 (1993) discloses an approach in which a bubble is made to communicate with the air (atmosphere) while the bubble grows. In this approach, since the distance between a heating resistor and a discharging port is short, the ratio of the work done by the bubble to the electric energy given to the heater is superior to such ratios of previous recording-liquid discharging heads. Furthermore, since almost all ink present between the heater and the discharging port is discharged, the volume of the discharged ink is stabilized.

The above-described conventional approaches, however, have the following problems to be solved.

First, the head which discharges ink by making the bubble communicate with the atmosphere operates rather well when discharging a small ink droplet (equal to or less than $15\times10^{-15}$ $m^3$). However, when intending to discharge a relatively large ink droplet, it is necessary to increase the size of the discharging port. As a result, the size of the discharging port greatly exceeds the distance between the heater and the discharging port, thereby providing a flat discharged droplet and causing instability in the direction of ink discharge. Furthermore, the capillary force while refilling ink decreases, thereby increasing the refilling time and preventing of high-speed recording.

On the other hand, in a conventional head in which discharging ports, each for discharging a very small droplet, are arranged at a high density, each of the discharging ports has an ink channel. Hence, each ink channel is narrow, thereby increasing the resistance of the channel and the refilling time.

In the heads in which a heater whose width or thickness has a gradient is disposed within an ink channel communicating with a discharging port and in which a plurality of heaters are disposed within an ink channel in order to perform gradation recording, since there is a correlation between the volume of a discharged ink droplet and the discharging speed, the quality of the recorded image is degraded.

That is, a head is designed to discharge large droplets at appropriate discharging speeds, the discharging speeds of small droplets decrease, thereby causing instability in the direction of ink discharge and in the recorded image. On the other hand, head is designed to discharge small droplets at appropriate discharging speeds, the discharging speeds of large droplets greatly increase, thereby causing splashing when the droplets reach the recording material, and degrading the quality of the recorded image.

SUMMARY OF THE INVENTION

It is an object of the present invention to provide an ink-jet head, an ink-jet-head cartridge, an ink-jet apparatus and an ink-jet recording method which can discharge ink at an appropriate speed whether the volume of the ink is small or large and which can refill the ink at a high speed.

It is another object of the present invention to provide a recording-liquid discharging head or the like which can particularly perform high-quality gradation recording.

According to one aspect, the present invention which achieves these objectives relates to an ink-jet head for discharging ink from discharging ports by the generation of bubbles, comprising a plurality of ink channels for guiding the ink to the corresponding discharging ports, and discharging units, each comprising a discharging port, and a heating element, provided for the discharging port, for generating a bubble for discharging the ink by providing the ink within the corresponding ink channel with thermal energy. A plurality of discharging units having different amounts of ink discharge are provided at each of the ink channels.

According to another aspect, the present invention which achieves these objectives relates to an ink-jet-head cartridge comprising the above-described ink-jet head and an ink receptacle for holding the ink to be supplied to the ink-jet head.

According to still another aspect, the present invention which achieves these objectives relates to an ink-jet apparatus comprising the above-described ink-jet head, and recording-medium conveying means for conveying a recording medium for receiving the discharged ink.

According to still another aspect, the present invention which achieves these objectives relates to an ink-jet recording method for performing recording by discharging different amounts of ink from discharging ports, comprising the steps of using a head in which a plurality of discharging units, each including a heating element for generating heat for discharging the ink, and a discharging port for discharging the ink, are provided at each ink channel, and performing recording by discharging different amounts of ink from the discharging ports by selectively driving the plurality of discharging units.

According to the above-described configurations and method, it is possible to discharge ink droplets having different sizes with accuracy, and to achieve gradation recording of a high picture quality. Furthermore, since discharging ports can be arranged at a high density, recordings of higher precision can be achieved.

BRIEF DESCRIPTION OF THE DRAWINGS

FIG. 1(*a*) is a plan view; and FIG. 1(*b*) is a cross-sectional view taken along line A–A' shown in FIG. 1(*a*);

DETAILED DESCRIPTION OF THE PREFERRED EMBODIMENTS

Preferred embodiments of the present invention will now be described in detail with reference to the drawings.

First Embodiment

Figure 1A:
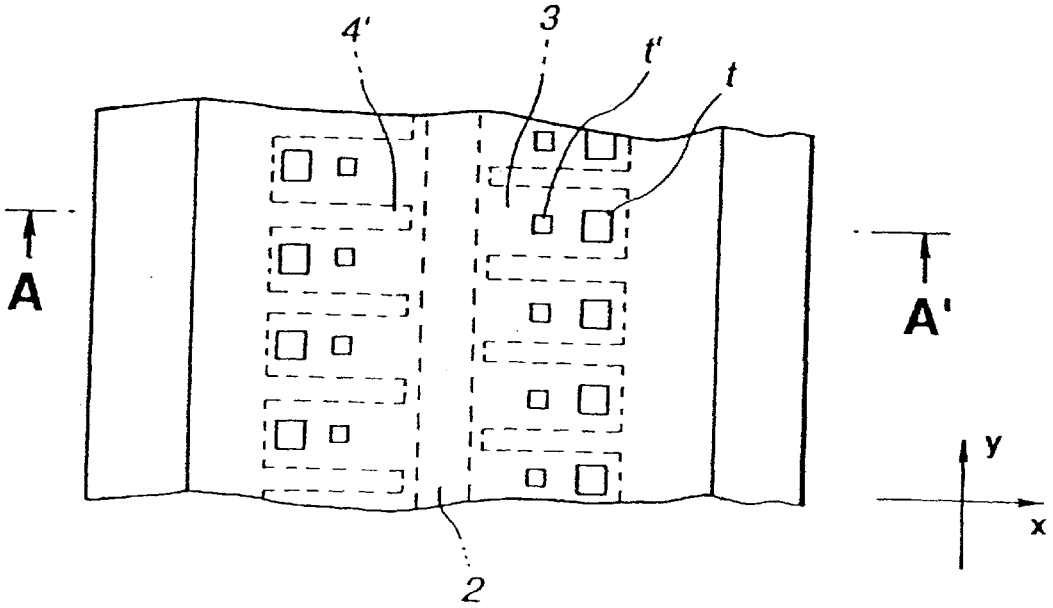
FIGS. 1(*a*) and 1(*b*) are schematic diagrams illustrating the configuration of an ink-jet head according to a first on embodiment of the present invention.
Figure 1B:
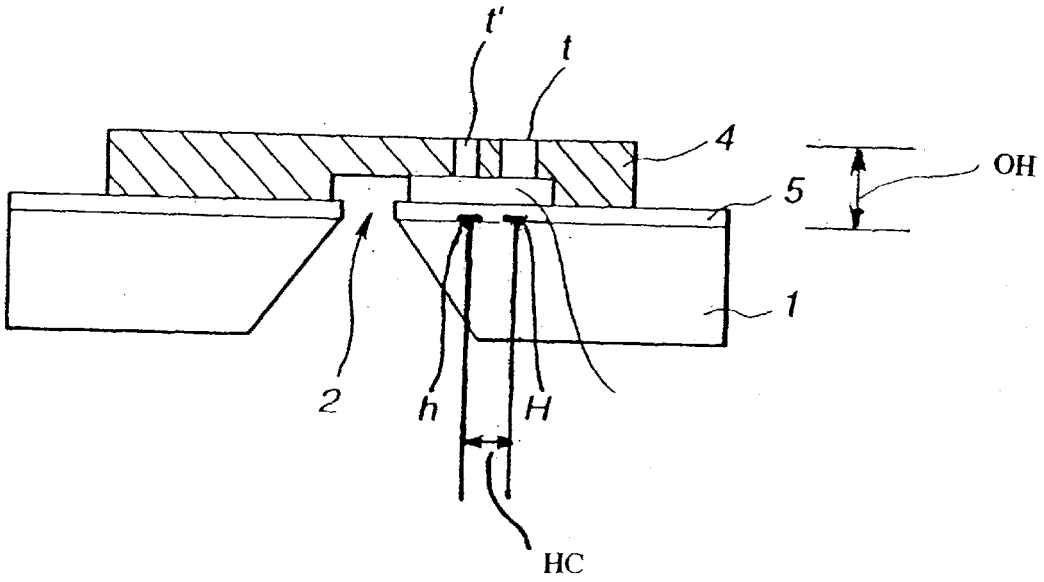

FIGS. 1(*a*) and 1(*b*) are schematic diagrams illustrating the configuration of an ink-jet head according to a first embodiment of the present invention: FIG. 1(*a*) is a plan view; and FIG. 1(*b*) is a cross-sectional view taken along line A–A' shown in FIG. 1(*a*).

In this head, an ink supply port 2 is formed in a silicon substrate 1 using anisotropic etching. Ink passes from the ink supply port 2 having a width of 57.1 μm through each of ink channels 3, and ink droplets are discharged from discharging ports t and t' which constitute a discharging unit. Heating elements (heaters) H and h, which constitute the discharging unit together with the discharging ports t and t', are disposed substantially immediately below the discharging ports t and t', respectively, which are provided at each of the ink channels 3. A channel provision member (nozzle member) 4 includes partitions 4' for providing the ink channels 3 and the discharging ports t and t', and is formed by a well-known production method comprising an exposure technique, etching and the like. Reference numeral 5 represents a protective film.

Respective pairs of heaters H and h are arranged in the y direction at a pitch of 84.7 μm in a staggered manner across the supply port 2. The head performs recording by performing scanning in the x direction. The pixel pitch of the head is 84.7 μm both in the x and y directions. Recording of 8,000 pixels per second is performed at the maximum speed with the pair of t and t' (or H and h). Accordingly, the maximum scanning speed of the head is (84.7/2 μm)×8,000/sec=338.8 mm/sec.

The partition 4' (for separating adjacent ink channels) hydraulically separates adjacent pairs, and has a width of 12.7 μm. The distal end of the partition 4' is situated at a position of 10 μm from the end of the supply port 2. The sheet resistance of the heater is 80 Ω, and the resistance of the interconnection is about 0.2 Ω. The driving signal (pulse) has a rectangular waveform, and the driving voltage is 14.5 V. The pulse widths are 4.0 μsec and 2.5 μsec for the heaters H and h, respectively. The ink used is obtained by dissolving 4% of C.I. Food Black 2 in an aqueous solution of DEG with a ratio of 80% of DEG and 20% of water.

The size of the discharging port t is 25 μm×25 μm, the size of the discharging port t' is 18 μm×18 μm, the size of the heater H is 32 μm×32 μm, and the size of the heater h is 24 μm×24 μm. The thickness of the nozzle material 4 is 20 μm, and the thickness of the portion of the discharging ports is 9 μm.

When individually driving the heaters H and h, the volumes of ink discharged from the discharging ports t and t' are $11\times10^{-15}$ $m^3$ and $5\times10^{-15}$ $m^3$, respectively. When simultaneously driving the heaters H and h, the volumes of ink discharged from the discharging ports t and t' are also $11\times10^{-15}$ $m^3$ and $5\times10^{-15}$ $m^3$, respectively, and ink can be discharged from the discharging ports t and t' for the same pixel. Accordingly, recording with one of four-step amounts of ink, i.e, 0 $m^3$, $5\times10^{-15}$ $m^3$, $11\times10^{-15}$ $m^3$ and $16\times10^{-15}$ $m^3$, can be selected in accordance with image data. When simultaneously driving the heaters H and h, the discharging speeds from t and t' are 19 m/s and 18 m/s, respectively. The refilling times are 95 μsec and 70 μsec for t and t', respectively.

Figure 2:
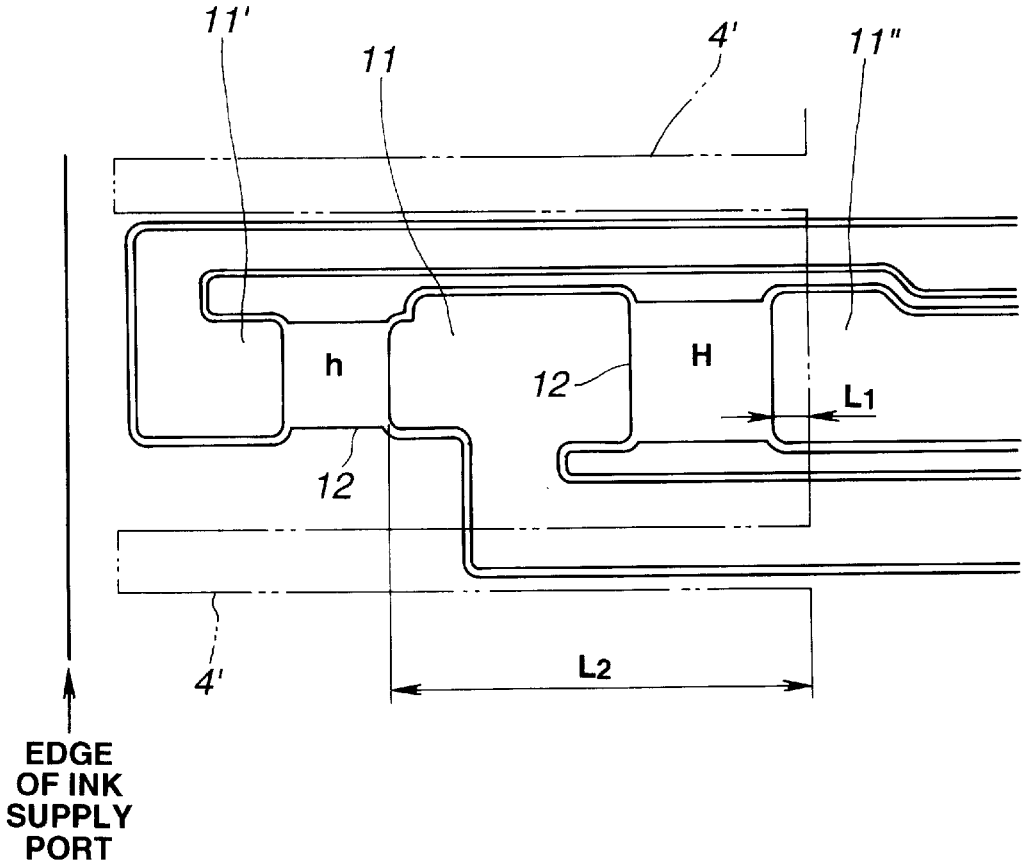
FIG. 2 is a diagram illustrating the pattern of interconnections for heaters H and h shown in FIG. 1(*b*)

FIG. 2 is a diagram illustrating the pattern of interconnections for the heaters H and h. In FIG. 2, reference numeral 11 represents an Al interconnection layer of a common electrode, reference numeral 11' represents an Al interconnection layer of an individual electrode for the heater h, and reference numeral 11" represents an Al interconnection layer of an individual electrode for the heater H. Reference numeral 12 represents a heater layer ($HfB_2$ layer). As for the relative position between the partition and the heaters, $L_1$=3 μm, and $L_2$=92 μm. Since the size of the heater H is 32 μm×32 μm as described above, the shortest distance between the heaters H and h is 92 μm−3 μm−32 μm=57 μm. This value is arranged to be sufficiently larger than the distance of 20 μm between the heater and the distal end of the discharging port, so that ink is not discharged from another discharging port when one of the heaters H and h is driven.

Figure 3:
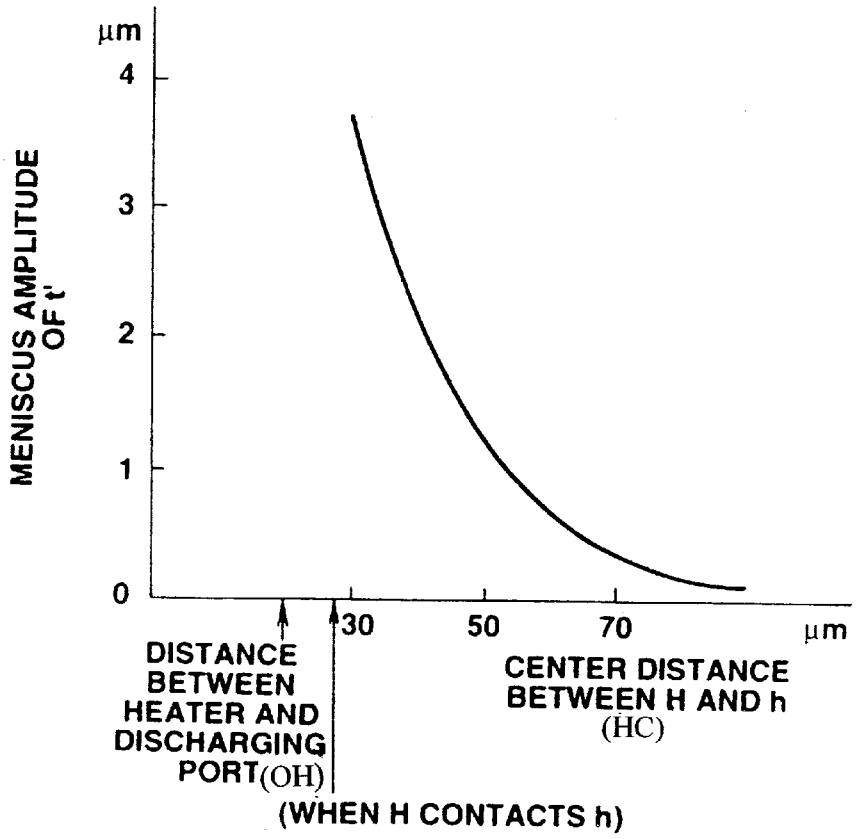
FIG. 3 is a graph illustrating the relationship between the meniscus amplitude of a discharging port t shown in FIGS. 1(*a*) and 1(*b*) when driving the heater H, and the center distance between the heaters H and h.

FIG. 3 is a graph illustrating the relationship between the meniscus amplitude of the discharging port t' (immediately above the heater h) when driving the heater H, and the center distance between the heaters H and h. FIG. 3 indicates that even if the heater h approaches the heater H in a state of substantially contacting the heater H, an ink droplet is not discharged from the discharging port t'. Such a property is obtained in the first embodiment because the height of the channel is very low (9 μm) and the distance between the heater and the discharging port is also short (20 μm).

The center distance between the heaters H and h is 92 μm+(24 μm/2)−3 μm−(32 μm/2)=85 μm, which value substantially equals the distance between two pixels. Actually, however, no problem arises if the center distance is arranged to be about an integer multiple of pixels ±20 μm. The distance between heaters facing across the supply port 2, for example, the distance in the x direction between the heater H at the right column and the heater h at the left column is 254.1 μm in FIG. 1, which equals the distance between six pixels. Accordingly, in the right column, the heater H performs recording of a pixel which precedes the heater h by two pixels, and the right column performs recording of a pixel which precedes the left column by six pixels.

When individually discharging ink from each discharging port in the above-described manner, in order to prevent ink from being discharged from another discharging port, it is desirable that the distance OH between the heater and the discharging port is equal to or less than 30 μm, and HC/OH>1 (HC: the center distance between the heaters).

Figure 4:
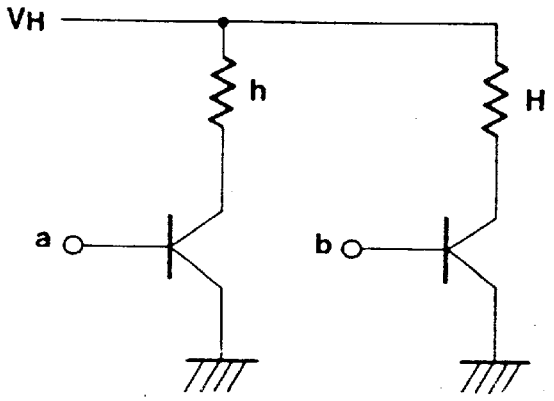
FIG. 4 is a diagram illustrating a driving circuit for the pair of heaters shown in FIG. 1(*b*)

FIG. 4 is a driving circuit for a pair of heaters. In FIG. 4, $V_H$ represents the power supply for driving the head, "a" represents a driving-signal input unit for the heater h, and "b" represents a driving-signal input unit for the heater H.

This head has 128 pairs of heaters at one side of the supply port, and therefore has 256 pairs of heaters in total. Respective 16 pairs of heaters in 16 blocks are sequentially driven from above (the +y direction). The time difference between adjacent blocks is 7 μsec. Hence, when, for example, recording a vertical line, the line shifts at every block and becomes oblique as a whole. In order to prevent such a phenomenon, scanning is performed in a state in which the head is inclined by $\tan^{-1}(2.3716/677.6)$ with respect to the y axis.

In the first embodiment, by using four (black, yellow, magenta and cyan) heads having the above-described configuration, four-value color recording with a pitch of 42.35 μm (600 dpi (dots per inch)) can be realized.

As a modification of the first embodiment, it is, of course, possible to maintain the linearity of recording of a vertical line by shifting the distance between the heater and the end of the supply port by 2.37 μm at every driving block, instead of inclining the head in the above-described manner.

In the first embodiment, the heaters H and h, and the orifices t and t' have different sizes. However, the present invention is not limited to such a case. For example, only one of the pairs may have different sizes.

In the head of the first embodiment, a bubble generated on the heater protrudes from the discharging port during its growth to communicate with the air.

Second Embodiment

Figure 5:
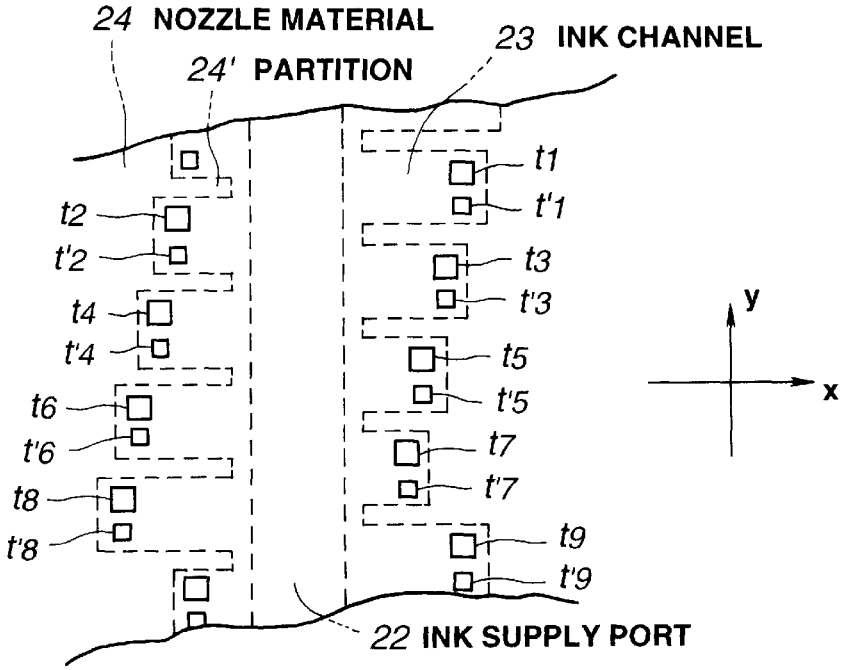
FIG. 5 is a schematic diagram illustrating the configuration of an ink-jet head according to a second embodiment of the present invention.
Figure 6:
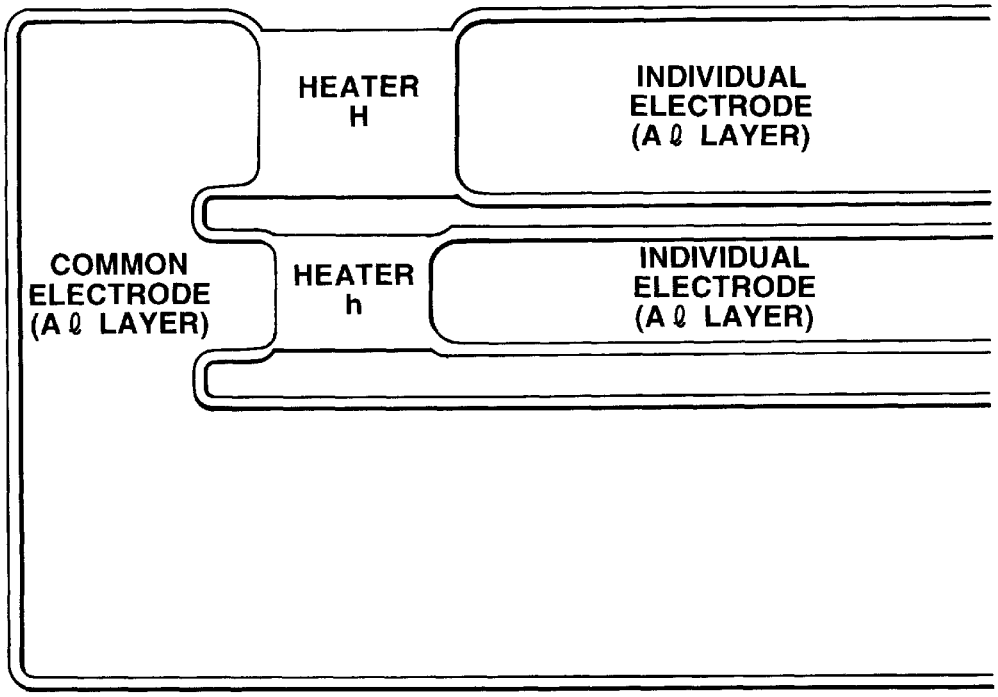
FIG. 6 is a diagram illustrating the pattern of interconnections for heaters H and h corresponding to discharging ports t and t' shown in FIG. 5, respectively.

FIG. 5 is a schematic diagram illustrating the configuration of an ink-jet head according to a second embodiment of the present invention. FIG. 6 is a diagram illustrating the pattern of interconnections for heaters H and h corresponding to discharging ports t and t', respectively, shown in FIG. 5.

The second embodiment differs from the first embodiment in that large and small heaters for a pixel are arranged in the y direction instead of being arranged in the x direction. The head of the second embodiment has recording densities of 1,200 pixels/25.4 mm in the x direction and 600 pixels/25.4 mm in the y direction. 64 pairs of heaters are provided at the right and left sides in total. The sizes of the discharging ports t and t' are 16 μm×16 μm and 13 μm×13 μm, respectively. The sizes of heaters H and h corresponding to the discharging ports t and t' are 20 μm (width)×24 μm (length) and 15 μm (width)×20 μm (length), respectively. The center distance between the heaters is 22 μm. The thickness of the nozzle member is 17 μm, and the thickness of the orifice portion is 8 μm. The volumes of ink discharged when individually driving the heaters H and h are $5\times10^{-15}$ $m^3$ and $3\times10^{-15}$ $m^3$, respectively, and the volume of ink discharged when simultaneously driving the heaters H and h is about $8\times10^{-15}$ $m^3$. The discharging speeds at that time from the discharging ports t and t' are 18 m/s and 16 m/s, respectively, and the refilling times for the discharging ports t and t' are 60 μsec and 45 μsec, respectively. When driving one of the heaters H and h, the meniscus of another orifice oscillates, but a droplet is not discharged. FIG. 6 is a diagram illustrating the pattern of interconnections for the heaters. The same driving circuit as that used in the first embodiment is used.

In FIG. 5, pairs of discharging ports $(t_1, t'_1)$, $(t_2, t'_2)$, . . . are arranged with a period of eight pairs, and the difference in the x coordinate between adjacent pairs is 5.30 μm. Driving is performed in the sequence of $(t_{8n+1}, t'_{8n+1})$, $(t_{8n+2}, t'_{8n+2})$, . . . , $(t_{8n+7}, t'_{8n+7})$ (n=0, 1, 2, 3, 4, 5, 6 and 7). The time difference in driving for adjacent blocks is 12.5 μsec.

Using this head, four-value recording could be excellently performed with 600×1,200 pixels/$25.4^2$ $mm^2$.

Third Embodiment

In the first and second embodiments, an ink channel for a pixel and an ink channel for an adjacent pixel are separated from each other using a partition, A third embodiment of the present invention has a feature in that, even when simultaneously driving heaters for a plurality of pixels, the heaters are disposed within an ink channel without being separated by a partition.

Figure 7:
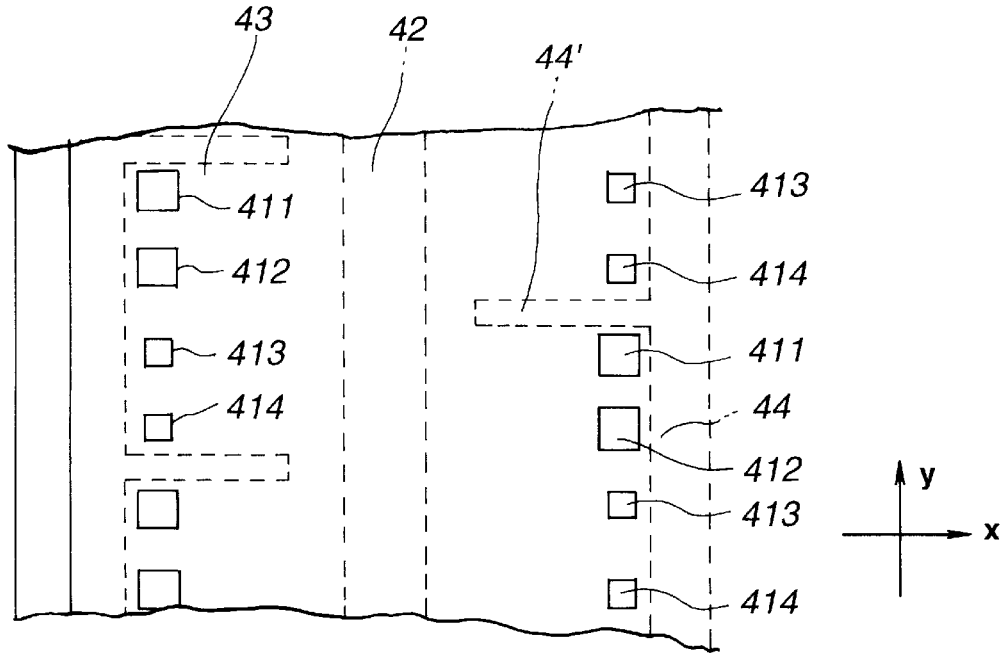
FIG. 7 is a schematic diagram illustrating the configuration of an ink-jet head according to a third embodiment of the present invention.

FIG. 7 is a diagram illustrating the arrangement of discharging ports of an ink-jet head according to the third embodiment. In FIG. 7, discharging ports 411–414 are disposed immediately above corresponding (four) heaters (not shown) which are simultaneously driven. The four discharging ports are disposed within an ink channel 43. The size of the discharging ports 411 and 412 is 22 μm×22 μm. The size of the corresponding heaters is 26 μm×32 μm, and the amount of ink discharge is $8\times10^{-15}$ $m^3$ (8 pl). On the other hand, the size of discharging ports 413 and 414 is 17 μm×17 μm, the size of the corresponding heaters is 24 μm×26 μm, and the amount of ink discharged is $4\times10^{-15}$ $m^3$ (4 pl). When discharging ports at the left column are large discharging ports (411, 412), discharging ports present in the x-axis direction at the right column are small discharging ports (413, 414). That is, discharging ports are arranged in the sequence of large and small or small and large in the x-axis direction. Accordingly, when performing recording by moving the head in the x-axis direction, ink droplets having large and small amounts of ink discharge can be superimposed on a pixel at a single scanning operation. As a result, this head can achieve recording having four gradation steps, i.e., 0 pl, 4 pl, 8 pl and 12 pl. The discharging ports are arranged at a pitch of 35.4 μm. Since discharging ports at one column facing discharging ports at another column across an ink supply port 42 are arranged in a staggered manner, a pixel density of 35.4 μm/2 is obtained.

An adjacent group of heaters separated from a group of heaters by a partition discharges ink at a timing shifted by 8 μsec from the concerned group of heaters.

The thickness of the nozzle material is 20 μm, and the thickness of the portion of the discharging ports is 8 μm. Hence, the height of the channel is 12 μm. When one heater is driven, ink is not discharged from adjacent discharging ports separated by 35.4 μm within the same block, although the meniscus slightly oscillates. Accordingly, even if four heaters surrounded by a partition are simultaneously driven, an interaction influencing a discharging operation is not produced. However, the provision of a plurality of heaters driven at different timings within the same block is not preferable, because, for example, while the meniscus of a discharging port is being refilled, a high-pressure bubble may be generated from another heater to discharge a very small droplet.

In the third embodiment, the discharging speed is 15 m/s, and the refilling time is 120 μsec.

Fourth Embodiment

In a fourth embodiment of the present invention, as in the foregoing embodiments, a plurality of discharging ports capable of discharging different amounts of ink which are simultaneously driven are provided within an ink channel.

Figure 8:
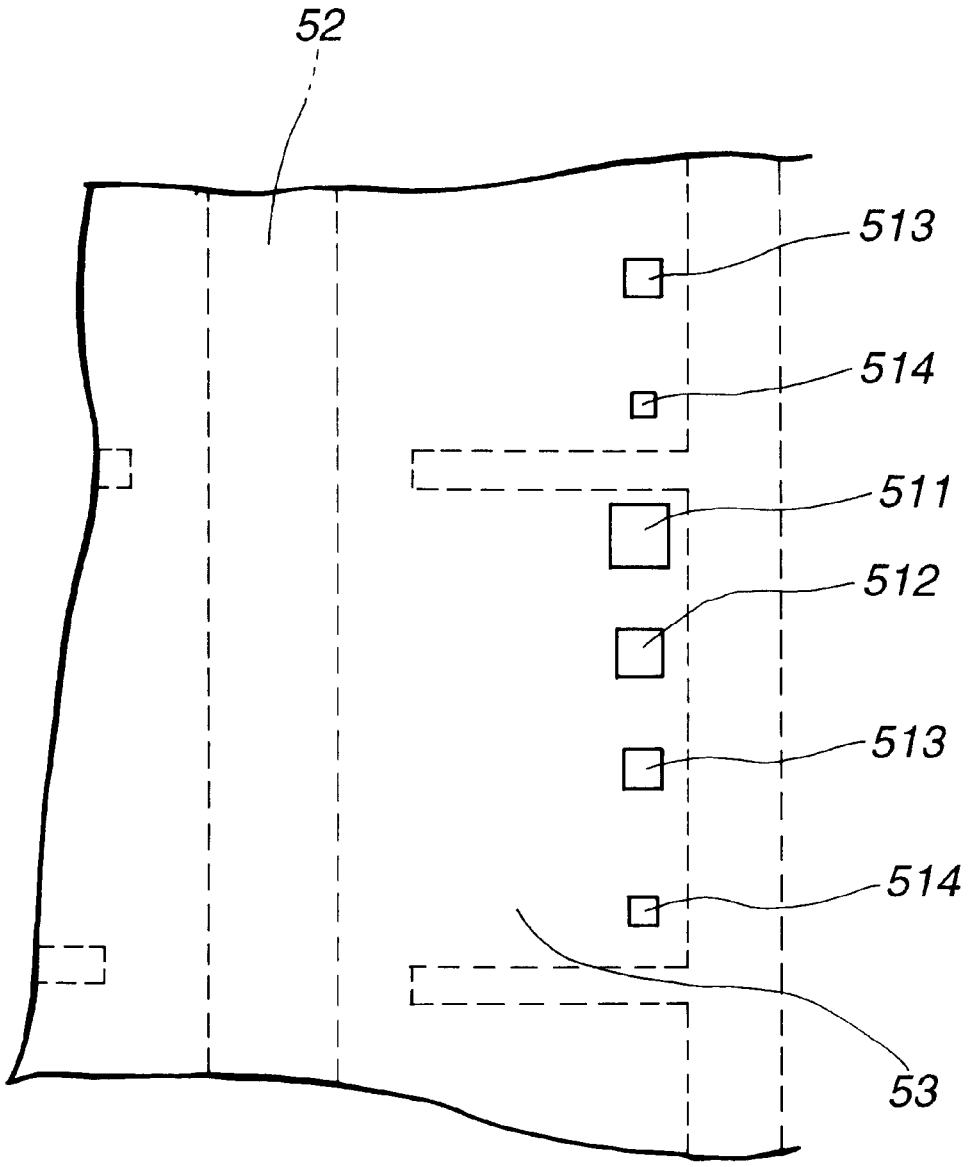
FIG. 8 is a schematic diagram illustrating the arrangement of discharging ports in a fourth embodiment of the present invention.

FIG. 8 is a schematic plan view illustrating the arrangement of discharging ports of an ink-jet head of the fourth embodiment. As in the third embodiment, discharging ports 511–514 are arranged at positions facing corresponding heaters.

In the fourth embodiment, four discharging ports for discharging different amounts of ink are provided in an ink channel 53 branching from an ink supply port 52 for supplying the head with ink. The sizes of the discharging ports 511, 512, 513 and 514 are 28 μm×28 μm, 22 μm×22 μm, 17 μm×17 μm and 13 μm×13 μm, respectively. The sizes of corresponding heaters are 34 μm×34 μm, 26 μm×34 μm, 26 μm×26 μm and 24 μm×24 μm, respectively. These pairs are arranged at a pitch of 42.2 μm. The amounts of ink discharged by these discharging units are $17.6\times10^{-15}$ $m^3$ (17.6 pl), $8.8\times10^{-15}$ $m^3$ (8.8 pl), $4.4\times10^{-15}$ $m^3$ (4.4 pl) and $2.2\times10^{-15}$ $m^3$ (2.2 pl). The structure of other components of the head are the same as in the third embodiment.

When performing recording by performing scanning using such a head, if it is arranged to record one pixel by a plurality of scanning operations, a recording having 16 gradation steps comprising integer multiples of 2.2 pl and having a maximum value of 33 pl can be achieved. When performing recording by two scanning operations, recording may be performed using the discharging ports 513 and 514 in a second scanning operation for a region where recording has been performed using the discharging ports 511 and 512 in a first scanning operation.

Other Embodiments

Figure 9:
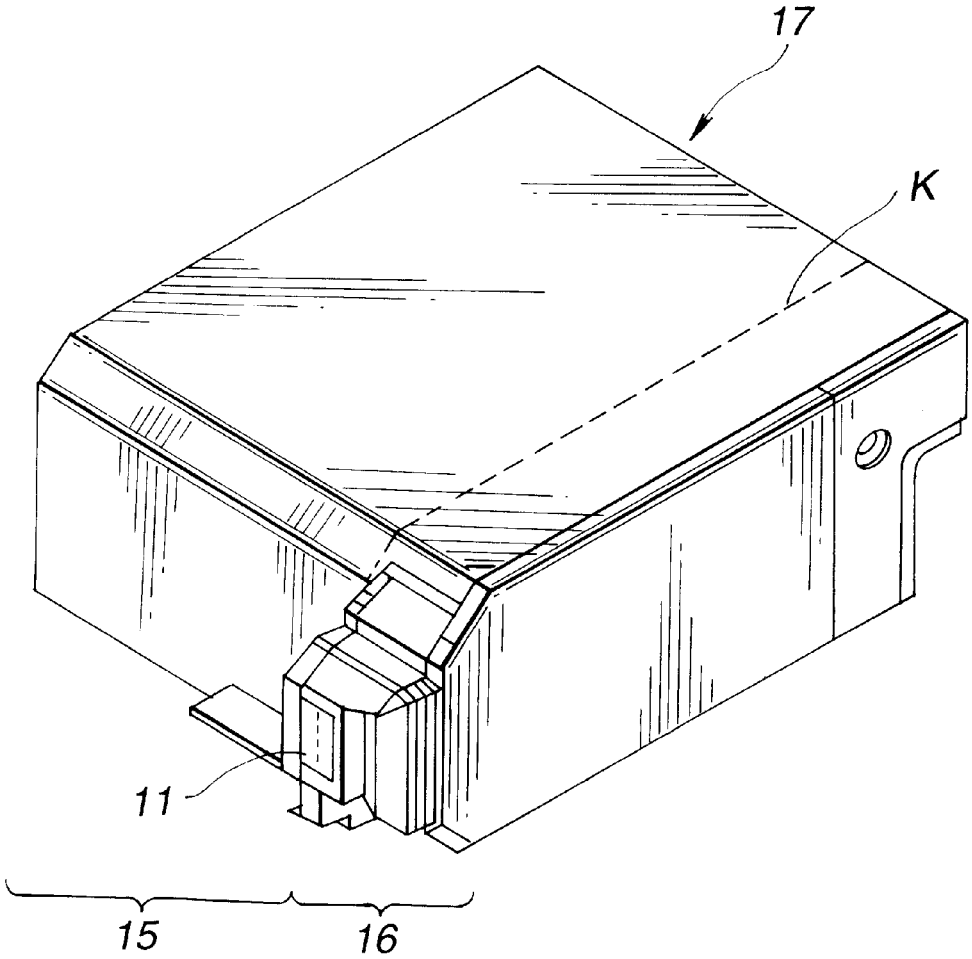
FIG. 9 is a perspective view illustrating the configuration of an ink-jet-head cartridge according to the if present invention.

FIG. 9 illustrates an ink-jet-head cartridge 17 in which an ink-jet head 16 having discharging ports 11 of the invention and an ink receptacle 15 holding ink to be supplied to the ink-jet head are separably connected at the position of a boundary line K. The ink-jet-head cartridge 17 includes an electric contact (not shown) for receiving an electric signal from a carriage of an apparatus when the ink-jet-head cartridge 17 is mounted in the carriage. The head is driven by the electric signal.

The ink receptacle 15 constituting the ink-jet-head cartridge 17 incorporates a fibrous or porous ink absorbing member in order to hold ink. The ink is held by this ink absorbing member.

Figure 10:
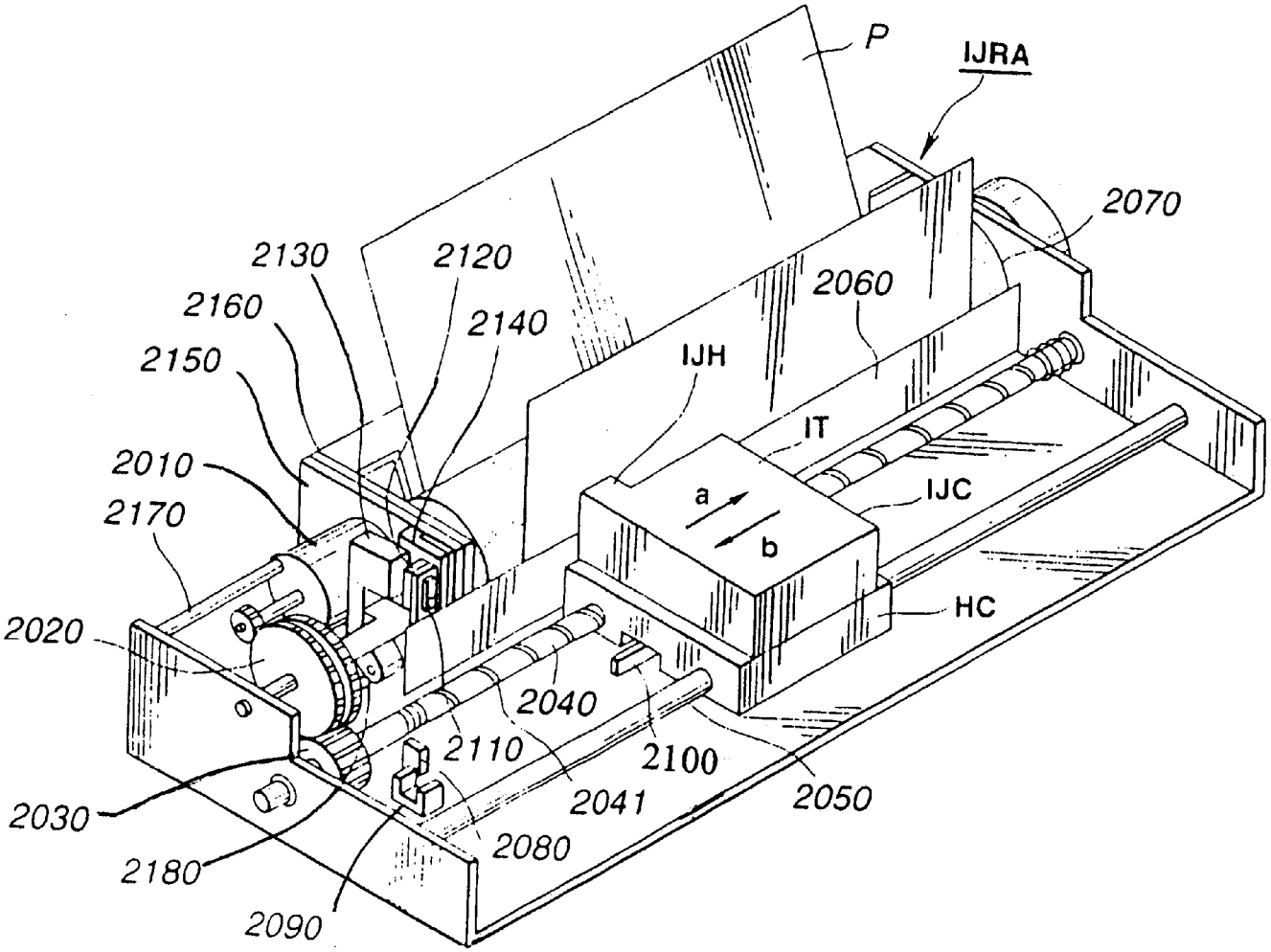
FIG. 10 is a perspective view illustrating the configuration of an ink-jet apparatus according to the present invention.

FIG. 10 illustrates an external appearance of an ink-jet recording apparatus in which the ink-jet head having the above-described configuration is mounted. This ink-jet recording apparatus IJRA includes a lead screw 2040 rotating linked with the forward or reverse rotation of a driving motor 2010 via driving-force transmission gears 2020 and 2030. A carriage HC where an ink-jet cartridge IJC in which the ink-jet head and an ink tank is integrated is mounted is supported on a carriage shaft 2050 and the lead screw 2040. The carriage HG includes a pin (not shown) engaging with a sprial groove 2041 of the lead screw 2040, and is reciprocated in the directions of arrows "a" and "b" in accordance with the rotation of the lead screw 2040. A sheet pressing plate 2060 presses paper P against a platen roller 2070, constituting conveying means for conveying a recording medium, over the moving range of the carriage HC. Members 2080 and 2090 constitute a photocoupler which operates as home-position detection means for confirming the presence of a lever 2100 provided on the carriage HC in this region and performing, for example, switching of the direction of revolution of the motor 2010. A member 2110 for capping the entire surface of the ink-jet head is supported on a supporting member 2120. Suction means 2130 for sucking the inside of the cap performs recovery by suction of the ink-jet head via an opening in the cap. A cleaning blade 2140 for cleaning the end surface of the ink-jet head is provided on a member 2150 so as to be movable in the forward and backward directions. The member 2150 is supported on a supporting plate 2160 of the main body of the apparatus. The structure of the cleaning blade 2140 is not limited to the above-described one, but any well-known cleaning blade may, of course, be used. A lever 2170 for recovering suction is moved in accordance with the movement of a cam 2180 engaging with the carriage HC. The driving force from the driving motor 2010 is thereby transmitted by well-known transmission means, such as clutch switching or the like.

The apparatus is configured such that each of the capping, cleaning, and recovery by suction operations can be performed at a corresponding position by the operation of the lead screw 2040 when the carriage HC is in the region of the home position. However, any other approach may be adopted provided that a desired operation is performed at a known timing.

The ink-jet recording apparatus of the present invention also includes driving-signal supply means for supplying the head with a signal for driving the heating elements of the ink-jet head of the present invention.

According to the present invention having the above-described configurations, ink can be discharged at an appropriate speed whether the volume of the ink droplet is large or small. It is thereby possible to achieve high-precision gradation recording. Furthermore, since a plurality of discharging units for discharging different amounts of ink are disposed within an ink channel, the density of the arrangement of discharging ports can be very high. According to the structures of the above-described embodiments, it is also possible to provide an appropriate discharging speed of ink and to shorten the time to refill the ink.

Many of the individual components shown in outline in the drawings are all well known in the ink-jet head, ink-jet-head cartridge, ink-jet apparatus and ink-jet recording method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet head comprising:

a plurality of discharging ports for discharging an ink;

a plurality of ink channels for guiding the ink to the discharging ports, each ink channel having at least two of the discharging ports corresponding thereto; and a plurality of discharging units, each comprising one said discharging port, and one heating element associated with that said discharging port, for generating a bubble for discharging the ink by applying to the ink within the corresponding ink channel thermal energy, wherein in each said ink channel a distance OH between the discharging port and the associated said heating element is not more than 30 μm, and a distance HC between a center of one said heating element and a center of another said heating element is greater than the distance OH, and each said discharging unit has an amount of ink discharge, wherein each of the ink channels contains several of the discharging units and at least some of the discharging units in a given said ink channel have different said amounts of ink discharge, wherein the heating elements may be driven individually or simultaneously, and an equivalent amount of ink is discharged from said discharging ports.

2. An ink-jet head according to claim 1, wherein in each said discharging unit the discharging port and the heating element of that said discharging unit face each other.

3. An ink-jet head according to claim 1, wherein at least some of said discharging units differ from one another in at least one of a size of the discharging port and a size of the heating element.

4. An ink-jet head according to claim 1, wherein at least same of said discharging units differ from one another in both a size of the discharging port and a size of the heating element.

5. An ink-jet-head cartridge, said cartridge comprising:

an ink-jet head comprising a plurality of discharging ports for discharging an ink; a plurality of ink channels for guiding the ink to the discharging ports, each ink channel having at least two of the discharging ports corresponding thereto, and a plurality of discharging units, each comprising one said discharging port, and one heating element associated with that said discharging port, for generating a bubble for discharging the ink by applying to the ink within the corresponding ink channel thermal energy, wherein in each said ink channel a distance OH between the discharging port and the associated said heating element is not more than 30 $\mu$m, and a distance HC between a center of one said heating element and a center of another said heating element is greater than the distance OH, and each said discharging unit has an amount of ink discharge, wherein each of the ink channels contains several of the discharging units and at least some of the discharging units in a given said ink channel have different said amounts of ink discharge; and an ink receptacle for holding the ink to be supplied to said ink-jet head, said ink receptacle being in fluid communication with said ink channels, wherein the heating elements may be driven individually or simultaneously, and an equivalent amount of ink is discharged from said discharging ports.

6. An ink-jet-head cartridge according to claim 5, wherein in each said discharging unit the discharging port and the heating element of that said discharging unit face each other.

7. An ink-jet-head cartridge according to claim 5, wherein at least some of said discharging units differ from one another in at least one of a size of the discharging port and a size of the heating element.

8. An ink-jet-head cartridge according to claim 5, wherein at least some of said discharging units differ from one another in both a size of the discharging port and a size of the heating element.

9. An ink-jet apparatus for discharging an ink from a plurality of discharging ports by generation of bubbles, said apparatus comprising:

a recording-medium conveying means for conveying a recording medium; and an ink-jet head which applied the ink onto the recording medium, comprising a plurality of discharging ports for discharging an ink, a plurality of ink channels for guiding the ink to the discharging ports, each ink channel having at least two of the discharging ports corresponding thereto, and a plurality of discharging units, each comprising one said discharging port, and one heating element associated with that said discharging port, for generating a bubble for discharging the ink by applying to the ink within the corresponding ink channel thermal energy, wherein in each said ink channel a distance OH between the discharging port and the associated said heating element is not more than 30 $\mu$m, and a distance HC between a center of one said heating element and a center of another said heating element is greater than the distance OH, and each said discharging unit has an amount of ink discharge, wherein each of the ink channels contains several of the discharging units and at least some of the discharging units in a given said ink channel have different said amounts of ink discharge, wherein the heating elements may be driven individually or simultaneously, and an equivalent amount of ink is discharged from said discharging ports.

10. An ink-jet apparatus according to claim 9, wherein in each said discharging unit the discharging port and the heating element of that said discharging unit face each other.

11. An ink-jet apparatus according to claim 9, wherein at least some of said discharging units differ from one another in at least one of a size of the discharging port and a size of the heating element.

12. An ink-jet apparatus according to claim 9, wherein at least some of said discharging units differ from one another in both a size of the discharging port and a size of the heating element.

13. An ink-jet recording method comprising the steps of:

providing a recording head, the recording head having a plurality of ink channels, each said ink channel having at least two discharging ports for discharging the ink, the ink channels guiding the ink to a plurality of discharging units, each said discharging unit including a heating element for generating heat for discharging the ink, and one said discharging port for discharging the ink, wherein in each said ink channel a distance OH between the discharging port and the associated said heating element is not more than 30 $\mu$m, and a distance HC between a center of one said heating element and a center of another said heating element is greater than the distance OH, and wherein each of the ink channels contains several of the discharging units and at least some of the discharging units in a given said ink channel have different amounts of ink discharge; and recording by discharging different amounts of the ink from the discharging ports by selectively driving the discharging units, driving individually or simultaneously the heating elements to discharge an equivalent amount of ink from the discharging ports.

14. An ink-jet recording method according to claim 13, wherein a pixel is formed by superimposing different amounts of the ink.

15. An ink-jet recording method according to claim 13, wherein a bubble is generated within the ink by the generation of the heat, and the ink is discharged by causing the bubble to communicate with an atmosphere.

* * * * *

UNITED STATES PATENT AND TRADEMARK OFFICE

CERTIFICATE OF CORRECTION

PATENT NO. : 6,447,088 B2
DATED : September 10, 2002
INVENTOR(S) : Masayoshi Tachihara et al.

It is certified that error appears in the above-identified patent and that said Letters Patent is hereby corrected as shown below:

Column 2,
Line 9, “head” should read -- a head --.

Column 9,
Line 18, “same” should read -- some --.

Signed and Sealed this

Twenty-ninth Day of June, 2004

JON W. DUDAS
*Acting Director of the United States Patent and Trademark Office*